United States Patent [19]

Duret et al.

[11] Patent Number: 4,798,993

[45] Date of Patent: Jan. 17, 1989

[54] ELECTRON GUN FOR ELECTRONIC TUBES

[75] Inventors: Robert Duret, Coignieres Maurepas; Georges Fleury, Gif Sur Yvette, both of France

[73] Assignee: Thomson-C.S.F., Paris, France

[21] Appl. No.: 708,691

[22] Filed: Mar. 6, 1985

[30] Foreign Application Priority Data

Mar. 9, 1984 [FR] France ..... 84 03640

[51] Int. Cl.[4] ..... H01J 29/46

[52] U.S. Cl. ..... 313/447; 313/454; 313/349

[58] Field of Search ..... 313/454, 304, 348, 349, 313/449, 296, 346 R, 447

[56] References Cited

U.S. PATENT DOCUMENTS

| | | | |
|---|---|---|---|
| 2,581,243 | 1/1952 | Dodds | 313/338 |
| 2,889,478 | 6/1959 | Rogers | 313/454 |
| 3,377,492 | 4/1968 | Oess | 313/71 |
| 3,500,110 | 3/1970 | Winsor | 315/3.5 |
| 3,852,633 | 12/1974 | Hunter | 313/411 |
| 4,147,953 | 4/1979 | Esterson | 313/349 X |
| 4,321,505 | 3/1982 | Miram et al. | 313/454 X |
| 4,583,021 | 4/1986 | Herriott et al. | 313/348 X |
| 4,593,230 | 6/1986 | True | 313/454 X |

*Primary Examiner*—David K. Moore
*Assistant Examiner*—K. Wieder
*Attorney, Agent, or Firm*—Roland Plottel

[57] ABSTRACT

In electron guns for electronic tubes, such as travelling wave tubes, for power modulating the electron beam, the distance between the cathode and the modulation grid increases the closer to the axis of the tube. Such a gun can be applied to travelling wave tubes operating with a zero enabling voltage and whose modulating frequency covers a very wide band.

6 Claims, 2 Drawing Sheets

ELECTRON GUN FOR ELECTRONIC TUBES

BACKGROUND OF THE INVENTION

1. Field of the Invention

The present invention relates to electronic guns for electronic tubes.

The following description relates to the case of guns for travelling wave tubes, but the invention also applies to guns intended for other sorts of electronic tubes, such for example as klystrons.

Some applications of travelling wave tubes require power modulation of the electron beam. In this case a cathode is used whose emissive surface is in the shape of a concave spherical skull cap, which is followed by a modulating grid, also in the form of a concave spherical skull cap, and whose distance from the cathode is constant at all points. This modulation grid may be successively subjected to two voltages:

- a beam disabling voltage, which is negative with respect to the cathode. There is no electron emission;
- a beam enabling voltage which is positive with respect to the cathode.

2. Description of the Prior Art

A disabling voltage of −100 V may for example be used with an enabling voltage of +100 V.

The problem which arises in this method of use is that the grid is considerably heated when it receives a positive enabling voltage of +100 V for example.

To overcome this problem of heating up of the grid, a zero enabling voltage is used and a disabling voltage a little higher in absolute value, equal for example to −300 V.

The problem which then arises is that the modulation grid vibrates strongly under the effect of the electric field.

In fact, the modulation grid is subjected to forces F proportional to the square of the electric field, and which may be expressed in the following way: $F=k.(V^2/d^2)$, where k is a factor of proportionality, V is the disabling or enabling voltage received by the grid and d is the distance between the cathode and the grid.

The use of a zero enabling voltage results both in a reduction of the distance d between the grid and the cathode, which is then of the order for example of a few hundredths of a millimeter, and an increase in the absolute value of the disabling voltage. The force F applied to the grid during disabling of the beam is then very high. The resulting vibrations have more especially the disadvantage of causing modulation of the power of the beam during the conduction phase. In some applications of travelling wave tubes, their modulation frequency covers a very wide band and it may happen that it is exactly equal to a mechanical resonance frequency of the grid. The amplitudes of the vibrations are then very high, which may cause short circuits between the grid and the cathode by placing them in contact. These vibrations may also cause destruction of the grid by exceeding the elastic limit of the material forming it.

The present invention provides a simple and efficient solution to the above mentioned problems.

SUMMARY OF THE INVENTION

The present invention relates to an electron gun for an electronic tube, comprising more especially a cathode whose emissive surface is in the form of a concave spherical skull cap, with in the neighbourhood of this cathode, a grid also in the form of a concave spherical skull cap which may be subjected to two different potentials for power modulating the electron beam emitted by the cathode, the distance between the cathode and the modulation grid increasing the closer to the axis of the tube.

The solution brought by the invention may be used whatever the value of the enabling voltage, whether it is zero or positive, and whatever the use to which the travelling wave tubes or other tubs fitted with such guns are put.

With the invention therefore, while keeping the same compactness for the electron gun, the value of the forces exerted on the grid along the axis of the tube and in the vicinity of this axis may be reduced by increasing the distance between the cathode and the grid at this location. Since, at its periphery, the grid is held in position by mechanical fixing means, there is no problem of vibration.

With the invention, the energizing force exerted at the center of the grid when the enabling voltage is zero may be made at least ten times smaller.

Experience has shown that this modification of the geometry of the gun causes no problem of focusing the beam, which was not a priori obvious.

Another embodiment of the invention concerns the case of electron guns comprising more especially a concave cathode, with in the vicinity of this cathode a first and a second grid, in the form of a concave spherical skull cap, the first grid being brought to the potential of the cathode and the second grid being subjected to two different potentials for power modulating the electron beam emitted by the cathode. According to the invention, the distance between these two grids increases the closer to the axis of the tube.

BRIEF DESCRIPTION OF THE DRAWINGS

Other objects, features and results of the invention will be clear from the following description, given by way of non limitative example and illustrated by the accompanying Figures which show.

In the different Figures, the same references designate the same elements but, for the sake of clarity, the sizes and proportions of the different elements have not been respected.

DESCRIPTION OF THE PREFERRED EMBODIMENTS

Figure 1:
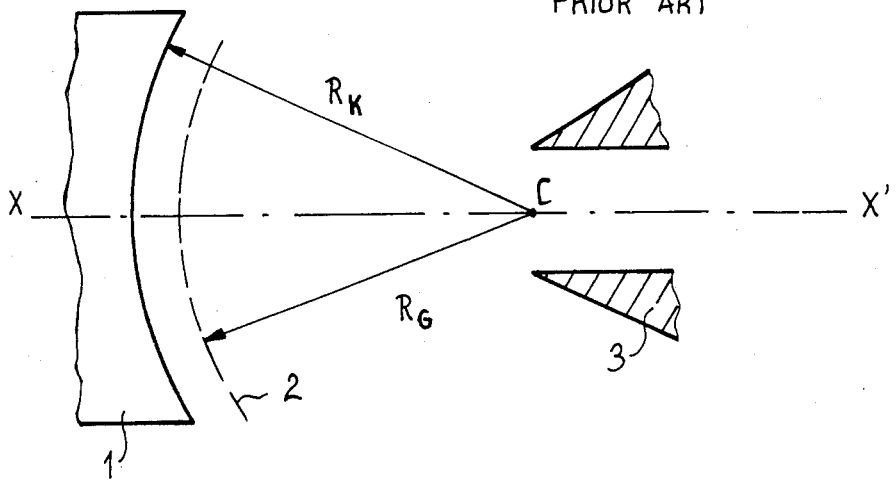
FIG 1 PRIOR ART
FIGS. 1 and 3, the diagrams of two embodiments of electron guns of the prior art.

FIG. 1 shows a diagram of one embodiment of an electron gun of the prior art.

It is a gun for a travelling wave tube operating with power modulation of the electron beam.

FIG. 1 is a schematical longitudinal section of this gun. On the left hand side of the Figure, cathode 1 has been shown whose emissive surface is in the form of a concave spherical skull cap. In the vicinity of the cathode is situated the modulation grid 2 which may be subjected to two different potentials for power modulating the beam. This grid is also in the form of a concave spherical skull cap. The radius of curvature $R_G$ of this grid is centered on the axis of the tube XX' at the same point C where the radius of curvature $R_K$ of the cathode is centered The distance between the cathode and the grid is therefore constant at all points. After the modulation grid, there has been schematically shown on the right hand side of the Figure the acceleration electrode 3. The disadvantages of this structure were explained in the introduction, in particular for certain uses of travelling wave tubes and when the enabling voltage is zero.

Figure 2:
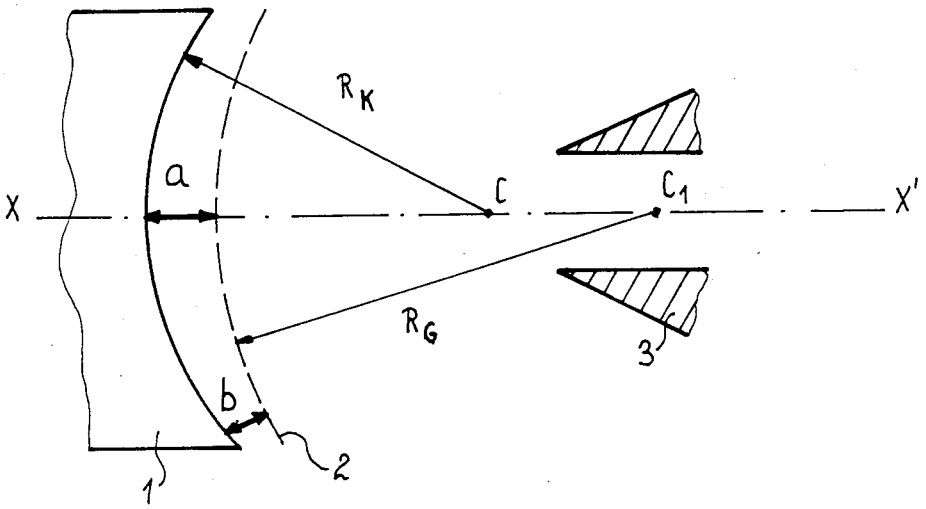
FIGS. 2 and 4 diagrams of two embodiments of electron guns according to the invention.

FIG. 2 shows the diagram of one embodiment of an electron gun in accordance with the invention.

With respect to FIG. 1, it can be seen that grid 2 is still in the form of a concave spherical skull cap, but the radius of curvature $R_G$ of the modulation grid 2 is centered on the axis of the tube XX' at a point $C_1$ which is situated, if we consider the direction of movement of the electrons, after point C where the radius of curvature $R_K$ of the cathode is centered.

It can therefore be seen that the distance between cathode 1 and the modulation grid 2 increases the closer to the axis of the tube. This distance is greater along the axis of the tube—dimension a—than at the periphery of the tube—dimension b.

It was explained in the introduction to the description that this structural modification resolves the problems arising with electron guns of the prior art.

The ratio a/b varies depending on the characteristics of the gun such as the emission density, the distance between the modulation grid and the cathode, the surface convergence of the electron beam . . . This ratio is substantially between 1.5 and 3: $1.5<a/b<3$.

Figure 3:
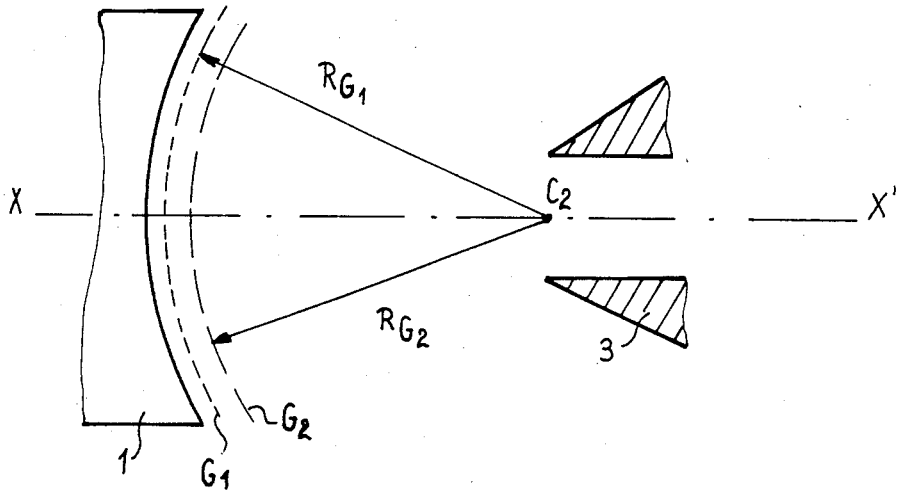
FIG 3 PRIOR ART

FIG. 3 is the diagram of another embodiment of a gun according to the prior art. It is a gun which is distinguished from that of FIG. 1 for the cathode is followed by a first grid $G_1$ and a second grid $G_2$, each in the form of a concave spherical skull cap. The first grid $G_1$ is brought to the potential of the cathode 1. It is a grid of the "shadow grid" type. It is the second grid $G_2$ which may be subjected to different potentials for power modulating the beam.

In the case of FIG. 3, the cathode and the two grids $G_1$ and $G_2$ have their radii of curvature centered at the same point C along the axis XX'.

The distance between the two grids $G_1$ and $G_2$ and between the cathode and the first grid $G_1$ is constant at all points.

Figure 4:
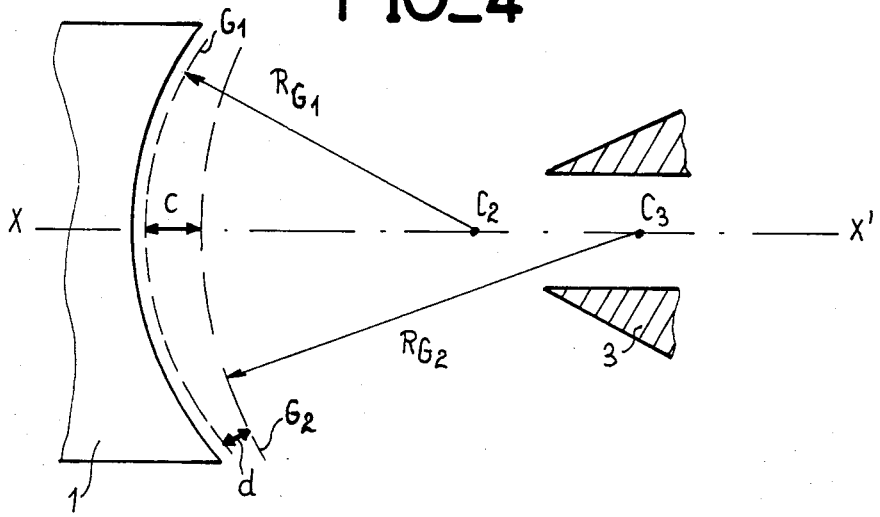

FIG. 4 shows the gun of FIG. 3 modified according to the invention. The distance between the two concave grids $G_1$ and $G_2$ increases the closer to the axis XX' of the tube. It is sufficient to compare the distance C with distance d in the figure. The radius of curvature of the second grid $G_2$ is centered at a point $C_3$, situated on the axis XX' after point $C_2$ where the radius of curvature of grid $G_1$ is centered.

We claim:

1. In an electron beam generating device for an electron tube comprising a cathode whose emissive surface is in the form of a concave spherical skull cap with an essentially uniform radius of curvature with, in the vicinity of this cathode, a modulation grid also in the form of a concave spherical skull cap which may be subjected to two different potentials for power modulating the electron beam emitted by the cathode, wherein the distance between the cathode and the modulation grid increases the closer to the axis of the tube completely around the axis.

2. In a electron ream generating device for an electronic tube comprising a concave shperical cathode width, in the vicinity of this cathode, first and second grids in the form of concave spherical skull caps, the first grid being brought to the potential of the cathode and the second grid being able to be subjected to different potentials for power modulating the electron beam emitted by the cathode, the distance between said two grids increasing the closer to the axis of the tube completely around the axis.

3. The beam generating device as claimed in claim 1, wherein the dimension a is the distances between the cathode and the modulation grid along the axis of the tube and the dimension b is the distance between said cathode and said modulation grid at the periphery of the tube and wherein the ratio a/b is between 1.5 and 3.

4. In an electron beam generating device for an electron tube comprising a cathode whose emissive surface is in the form of a spherical skull cap with, in the vicinity of this cathode, a modulation grid also in the form of a spherical skull cap which may be subjected to two different potentials for power modulating the electron beam emitted by the cathode, wherein the distance between the cathode and the modulation grid increases the closer to the axis of the tube completely around the axis and wherein the dimension a is the distance between said cathode and said modulation grid along said axis of the tube and the dimension b is the distance between said cathode and said modulation grid at the periphery of said tube and wherein the ratio a/b is between 1.5 and 3.

5. An electron beam generating device for an electron tube in which an electron beam is modulated comprising a cathode whose electron emissive surface is in the form of a concave spherical skull cap with an essentially uniform radius of curvature for emitting electrons which are converged into an electron beam, and a modulating grid in the form of a concave spherical skull cap with an essentially uniform radius of curvature larger than that of the cathode surface and positioned in the path of the electron beam for flow of the electron beam therethrough, the centers of the radii of curvature of the cathode surface and the modulating grid being along a common axis whereby the spacing between the cathode surface and the modulating grid is greatest along the common axis and decreases with distance away from the common axis.

6. An electron beam generating device for an electron tube in which an electron beam is modulated comprising a cathode whose electrode emissive surface is in the form of a concave spherical skull cap with an essentially uniform radius of curvature for emitting electrons which are converged into an electron beam, a first concave spherical grid electrode of essentially uniform radius of curvature equal to that of the cathode spaced uniformly from the cathode, and a second concave spherical grid electrode of essentially uniform radius of curvature larger than that of said cathode and said first grid electrode, the center of curvature of the cathode, the first grid electrode and the second grid electrode being along a common axis whereby the separation between the first and second control grids is largest along the common axis and decreases with increasing distance away from said axis.

* * * * *